US005727043A

United States Patent [19]

Watanabe

[11] Patent Number: 5,727,043

[45] Date of Patent: Mar. 10, 1998

[54] X-RAY DIFFRACTOMETER

[75] Inventor: Kazuyuki Watanabe, Kanagawa, Japan

[73] Assignee: Shimadzu Corporation, Kyoto, Japan

[21] Appl. No.: 668,336

[22] Filed: Jun. 25, 1996

[30] Foreign Application Priority Data

Jun. 27, 1995 [JP] Japan ..... 7-160500

[51] Int. Cl.[6] ..... H05G 1/34

[52] U.S. Cl. ..... 378/109; 378/110; 378/71

[58] Field of Search ..... 378/71, 70, 101, 378/106, 107, 108, 109, 110, 111, 112, 114, 115, 116, 118

[56] References Cited

U.S. PATENT DOCUMENTS 4,775,992 10/1988 Resnick et al. ..... 378/110
4,809,311 2/1989 Arai et al. ..... 378/110

*Primary Examiner*—Don Wong
*Attorney, Agent, or Firm*—Nikaido, Marmelstein, Murray & Oram LLP

[57] ABSTRACT

It is an object of the present invention to provide an x-ray diffractometer for measuring an x-ray diffraction pattern obtained by irradiating x-rays 6 to a sample 7, in which, even though irradiation/non-irradiation of x-rays 6 to the sample 7 are repeated, a target in an x-ray tube bulb 1 is not contaminated and a filament 3 is not thermally stressed, thus improving the practical lifetime of the x-ray tube bulb 1. To achieve this object, the x-ray diffractometer of the present invention is arranged such that x-ray irradiation/non-irradiation selecting means 17 is arranged to switch states of supply and non-supply of a tube voltage to the x-ray tube bulb 1, and that an x-ray generating power source device 11 comprises filament preliminary heating current supply means 16 for letting flow a preset current in the filament 3 of the x-ray tube bulb 1 in the state where a tube voltage is not supplied. According to the arrangement above-mentioned, in the x-ray non-irradiation state, each of the tube voltage and current of the x-ray tube bulb 1 becomes zero, and the filament 3 is brought to a preliminarily heated state.

3 Claims, 2 Drawing Sheets

X-RAY DIFFRACTOMETER

[BACKGROUND OF THE INVENTION]

The present invention relates to an x-ray diffractometer to be used, for example, for measuring the x-ray diffraction pattern of a polycrystalline sample, a powder sample or the like.

Generally, an x-ray diffractometer comprises an x-ray generator for irradiating x-rays to a sample, and an x-ray detector for measuring the x-rays diffracted by the sample, and is arranged to measure the pattern of the x-rays diffracted by the sample. The x-ray generator for generating x-rays to be irradiated to a sample, generally comprises an x-ray tube bulb and an x-ray generating power source device for supplying a tube voltage and a tube current to the tube bulb.

In such an x-ray diffractometer, when the power source is turned on to start the operation of the diffractometer, an electric power is also supplied to the x-ray generating power source device to set the tube voltage and the tube current to predetermined values, respectively, thus worming up the x-ray tube bulb in order to stabilize x-rays emitted from the x-ray tube bulb.

When the filament current of the x-ray tube bulb is frequently turned on and off, the filament is thermally stressed and therefore liable to be burnt out. Accordingly, each of diffractometers of the type above-mentioned is often arranged such that, after once started, the x-ray generator remains operated to maintain the generation of x-rays until a series of measurement and analysis are finished. In this connection, the following arrangement is adopted to prevent x-rays generated by the x-ray tube bulb from being emitted toward the sample placing position and its peripheral space while neither measurement nor analysis of x-ray diffraction pattern is being conducted. That is, the x-ray tube bulb is housed in a tube bulb holder, the tube bulb holder is shaped to surround the x-ray tube bulb and has an x-ray outlet window, and there is disposed a shutter capable of intercepting x-rays emitted through the x-ray outlet window. Thus, irradiation/non-irradiation of x-rays to a sample is selected by driving the shutter.

In such an x-ray diffractometer of prior art to be used in the manner above-mentioned, the x-ray tube bulb remains still receiving the tube voltage and current even though x-rays are actually not irradiated to the sample. Such a usage is preferable in view of stabilization of x-rays to be generated, but disadvantageously shortens the practical lifetime of the tube bulb. More specifically, while a tube voltage and a tube current are being supplied to the x-ray tube bulb, the filament made of tungsten is gradually evaporated and sticks to the target in the tube bulb. This causes the x-rays generated from the target to mixingly contain the characteristic x-rays of tungsten in addition to the characteristic x-rays of the original target substance. When such mixing of x-rays is increased to such an extent as to interfere with the measurement of diffraction pattern of x-rays diffracted by a sample, the x-ray tube bulb cannot be used any more. This means that the lifetime of the x-ray tube bulb has substantially expired.

To prevent the inconvenience above-mentioned, the provision may be made such that the supply of an electric power to the x-ray tube bulb is stopped while no x-rays are being irradiated to a sample. However, even in such an arrangement, turning the x-ray generating power source to on/off is frequently repeated, causing the filament to be repeatedly heated and cooled. Accordingly, the filament is thermally stressed, causing the same to be readily burnt out. Thus, the provision above-mentioned does not serve as a measure for lengthening the lifetime of the x-ray tube bulb.

[OBJECTS AND SUMMARY OF THE INVENTION]

Figure 1:
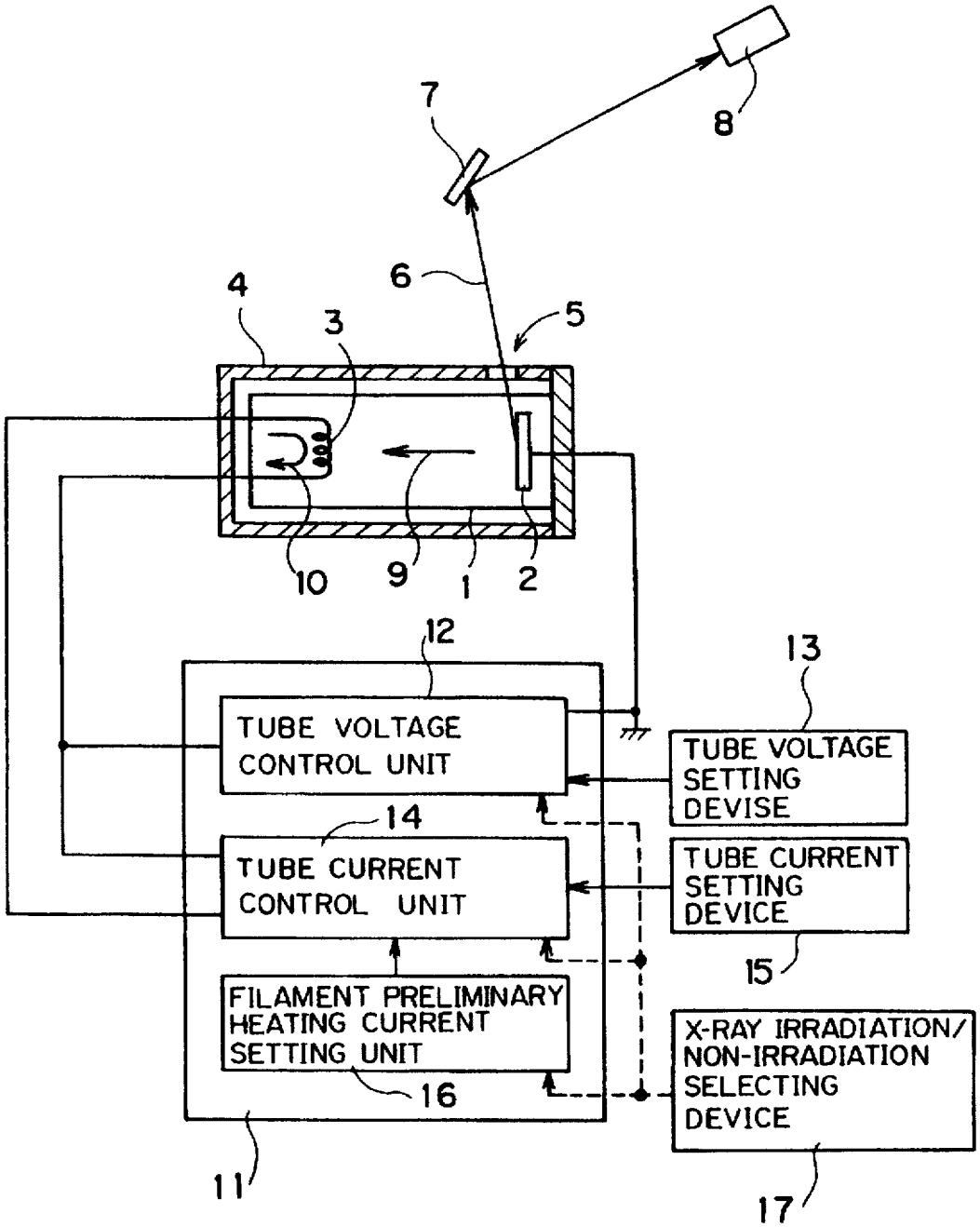
FIG. 1 is a schematic block diagram of the circuit arrangement of an embodiment of the present invention.

It is an object of the present invention to provide an x-ray diffractometer which restrains a target in an x-ray tube bulb from being contaminated and which restrains the filament in the x-ray tube bulb from being burnt out, thus substantially lengthening the lifetime of the x-ray tube bulb.

To achieve the object above-mentioned, the present invention provides an x-ray diffractometer having an x-ray tube bulb, an x-ray generating power source device for supplying a predetermined tube voltage and a predetermined tube current to the x-ray tube bulb, and x-ray irradiation/non-irradiation selecting means for selecting one of states of irradiation and non-irradiation of x-rays generated from the x-ray tube bulb to a sample, and this x-ray diffractometer is characterized in that: the x-ray irradiation/non-irradiation selecting means is arranged to switch states of supply and non-supply of the tube voltage to the x-ray tube bulb; and the x-ray generating power source device comprises filament preliminary heating current supply means for letting flow a preset current in the filament of the x-ray tube bulb in the state of non-supply of the tube voltage to the x-ray tube bulb.

According to the present invention, the current to be let flow in the filament of the x-ray tube bulb in the x-ray non-irradiation state, is preferably a minimum required for preventing the filament from being lowered in temperature down to a certain level or less.

According to the present invention, (i) the x-ray generating power source device may be arranged such that the tube voltage of the x-ray tube bulb is controlled by a feedback control system; that is, the x-ray generating power source device may comprise a tube voltage control feedback loop for comparing a moment-by-moment detection signal of the tube voltage of the x-ray tube bulb and a tube voltage target value signal with each other and for controlling the tube voltage according to a deviation between the detection signal and the target value signal, and (ii) the x-ray irradiation/non-irradiation selecting means may be arranged such that, instead Of the tube voltage target value signal, such a target value signal as to generate a tube voltage on the level of a grounding potential is supplied to the x-ray generating power source device in the x-ray non-irradiation state.

According to the present invention, (i) the x-ray generating power source device may be arranged such that the tube current of the x-ray tube bulb is also controlled by a feedback control system; that is, the x-ray generating power source device may comprise a tube current control feedback loop for comparing a moment-by-moment detection signal of the tube current of the x-ray tube bulb and a tube current target value signal with each other and for controlling, according to a deviation between the detection signal and the target value signal, the tube current to be supplied to the filament of the x-ray tube bulb, and (ii) the filament preliminary heating current supply means may be arranged such that, in the x-ray non-irradiation state, a constant preset current flows in the filament without the use of the tube current control feedback loop.

According to the present invention, in the state of measurement of the x-rays diffracted by a sample, i.e., in the state where x-rays are actually irradiated to a sample, a predetermined tube voltage and a predetermined tube current are given to the x-ray tube bulb as done in an x-ray diffractometer of prior art. In other state than the state above-mentioned, i.e., in the state where x-rays are not irradiated to a sample, no tube voltage is supplied to the x-ray tube bulb and a preset preliminary heating current is let flow in the filament of the x-ray tube bulb. In the x-ray non-irradiation state, the arrangement above-mentioned not only restrains the tungsten forming the filament from being evaporated and sticking to the target, but also prevents the filament to be cooled. Thus, there is no possibility of the filament being thermally stressed.

In such a specific preferable arrangement for providing the non-irradiation state, there is used a simple arrangement in which such a target value signal as to generate a tube voltage on the level of a grounding potential is supplied, instead of the tube voltage target value signal for the tube voltage control feedback loop, and in which means for supplying a constant heating current is used to let flow a suitable current in the filament of the x-ray tube bulb without the use of the tube current control feedback loop. Accordingly, the object of the present invention can be achieved with a relatively simple and economical structure.

[DESCRIPTION OF PREFERRED EMBODIMENTS]

The following description will discuss a preferred embodiment of the present invention with reference to the attached drawings.

FIG. 1 is a block diagram of the circuit arrangement of an embodiment of the present invention. An x-ray tube bulb 1 incorporates a target 2 and a filament 3 disposed opposite thereto, and is generally housed in a tube bulb holder 4. The tube bulb holder 4 has an x-ray window 5, through which x-rays 6 generated by the x-ray tube bulb 1 are irradiated to a sample 7. The x-rays 6 are diffracted by the sample 7, and the diffracted x-rays are detected by a detector 8. The sample 7 and the detector 8 are respectively supported by θ-and 2θ-shafts of a goniometer known per se (not shown). More specifically, the sample 7 and the detector 8 are arranged such that, according to a so-called θ-2θ interlock scan method or the like, the irradiation angle of x-rays incident upon the sample 7 is changed from time to time, and the diffracted x-rays are detected at each of the irradiation angles, thus enabling an x-ray diffraction pattern of the sample 7 to be measured.

An x-ray generating power source device 11 is arranged to supply a tube voltage and a tube current to the x-ray tube bulb 1. In this embodiment, the voltage of the target 2 of the x-ray tube bulb 1 serves as a grounding potential, and a negative voltage of about −10 kV to about −60 kV is applied, as the tube voltage, to the filament 3 while x-rays are being generated. The tube voltage applied to the filament 3 is maintained, by a tube voltage control unit 12 of the x-ray generating power source device 11, at a value set by a tube voltage setting device 13. An electric current flowing from the target 2 to the filament 3, in other words, an electric current of an electronic beam flowing from the filament 3 to the target 2, i.e., a tube current 9, is controlled in the range of about 5 mA to about 100 mA by a tube current control unit 14 of the x-ray generating power source device 11. More specifically, the tube current is controlled in the following manner. To maintain the tube current 9 at the current value set by a tube current setting device 15, a filament current 10 for heating the filament 3 is controlled to control the amount of thermoelectrons generated from the filament 3. When the tube voltage and the tube current are respectively set within the ranges above-mentioned, the thermoelectrons generated from the filament 3 are accelerated by the tube voltage and come into collision with the target 2, such that x-rays are generated from the target 2.

In this embodiment, the x-ray generating power source device 11 comprises a filament preliminary heating current setting unit 16, in addition to the tube voltage control unit 12 and the tube current control unit 14. The filament preliminary heating current setting unit 16 is arranged to let flow a preset constant current in the filament 3 to maintain the temperature thereof at a certain level or more while an x-ray non-irradiation instruction is given from an x-ray irradiation/non-irradiation selecting device 17 to be discussed later. Preferably, the current to be let flow in the filament 3 in the x-ray non-irradiation state, is a minimum required for maintaining the temperature of the filament 3.

In this embodiment, the x-ray irradiation/non-irradiation selecting device 17 forms part of a control device, actually mainly comprising a computer, for the whole x-ray diffractometer. The x-ray irradiation/non-irradiation selecting device 17 is arranged to supply an instruction signal for automatically switching the x-ray irradiation state to the x-ray non-irradiation state at the time when there has been judged, in the x-ray irradiation state, the completion of a series of measurement operations that, while the sample 7 and the detector 8 are being moved according to the θ-2θ interlock scan method, x-rays are irradiated to the sample 7 to measure the x-ray diffraction pattern. This instruction signal for switching the x-ray irradiation state to the x-ray non-irradiation state, is supplied simultaneously to the tube voltage control unit 12, the tube current control unit 14 and the filament preliminary heating current setting unit 16. In the x-ray non-irradiation state, the tube voltage of the x-ray tube bulb 1 is not being supplied; that is, a difference in potential between the target 2 and the filament 3 is equal to 0 V such that no x-rays are generated, and the current flowing in the filament 3 is maintained at a preliminary heating constant value as mentioned earlier. Accordingly, even though the changeover from x-ray irradiation to x-ray non-irradiation and vice versa is frequently repeated, the filament 3 is not thermally stressed because the temperature thereof is maintained at a certain level or more, and the material of the filament 3 is not evaporated, thus preventing the target 2 from being contaminated.

Figure 2:
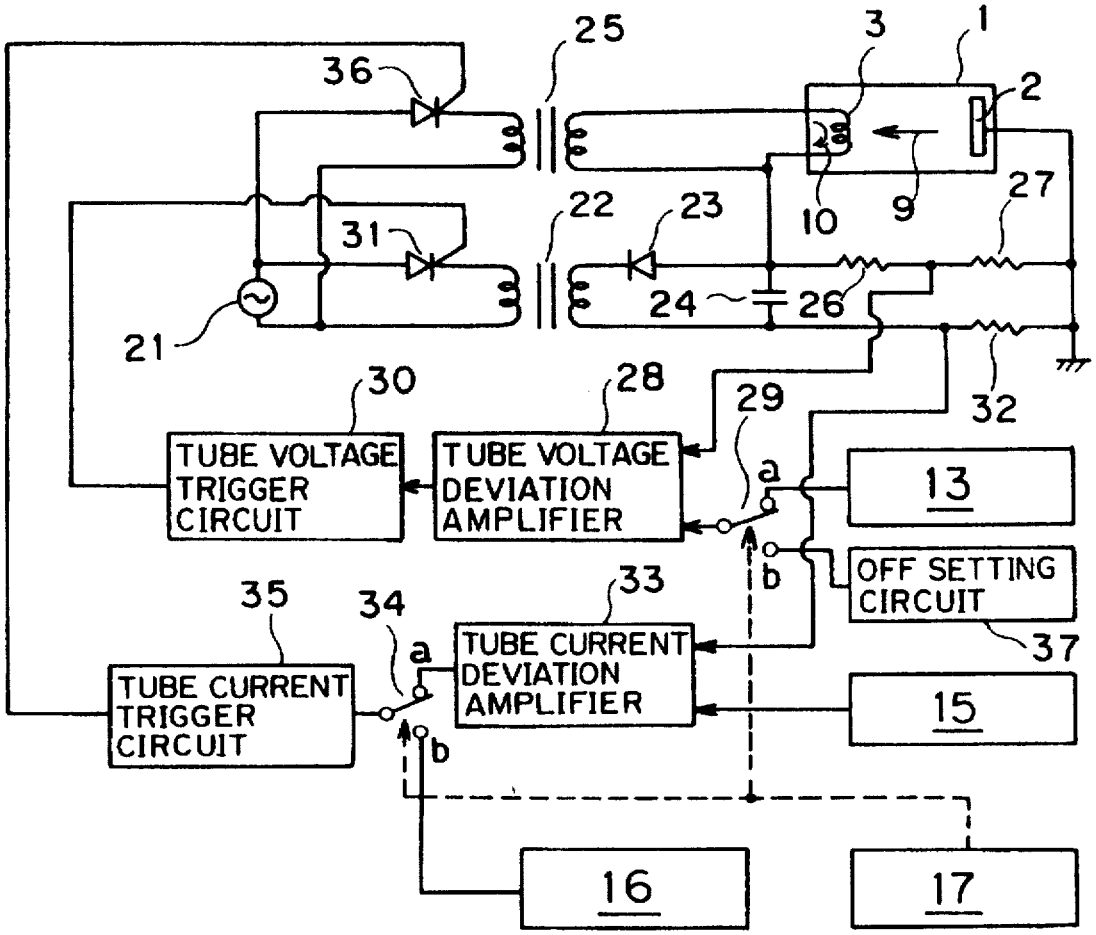
FIG. 2 is a block diagram of a specific circuit arrangement of main portions of the embodiment in FIG. 1.

FIG. 2 shows an example of a more specific circuit arrangement of the embodiment above-mentioned. The tube voltage for the x-ray tube bulb 1, is applied to the filament 3 after a voltage supplied from a commercial AC power source 21 has been raised by a transformer 22 and smoothed by a smoothing circuit comprising a diode 23, a capacitor 24 and the like. On the other hand, the filament current 10 for generating thermoelectrons from the filament 3, is obtained by converting, by a transformer 25, the voltage supplied from the commercial AC power source 21 into a value suited for the resistance value of the filament 3.

The tube voltage is controlled in a feedback control manner as set forth below. The tube voltage applied to the filament 3 is detected as divided into a voltage of several volts by resistances 26, 27. This tube voltage detection signal is entered into one input terminal of a tube voltage deviation amplifier 28. The tube voltage setting device 13 generates a tube voltage target value signal according to an optionally preset tube voltage value, and the tube voltage target value signal is entered into the other input terminal of the tube voltage deviation amplifier 28 through a switch 29 (which is set to the "a" side in FIG. 2 when the x-ray irradiation state is selected). The tube voltage deviation amplifier 28 compares the tube voltage target value signal and the tube voltage detection signal with each other and controls, through a tube voltage trigger circuit 30, the conduction phase of a thyristor (SCR) 31 inserted in the transformer 22 such that the deviation between both signals becomes 0.

Also, the tube current is controlled in a feedback control manner as set forth below. The tube current 9 flowing in the x-ray tube bulb 1 is converted into a voltage signal of several volts by a tube current detection resistance 32. This tube current detection signal is entered into one input terminal of a tube current deviation amplifier 33. The tube current setting device 15 generates a tube current target value signal according to an optionally preset tube current value, and this tube current target value signal is entered into the other input terminal of the tube current deviation amplifier 33. The tube current deviation amplifier 33 compares the tube current target value signal with the tube current detection signal and controls, through a switch 34 (which is set to the "a" side in FIG. 2 when the x-ray irradiation state is selected) and a tube current trigger circuit 35, the conduction phase of a thyristor (SCR) 36 inserted in the primary side of the transformer 25 such that the deviation between both signals becomes 0. When the conduction phase of the thyristor 36 is controlled to change the filament current 10 flowing in the filament 3, the amount of thermoelectrons generated from the filament 3 is changed. As a result, the value of the tube current 9 flowing from the target 2 to the filament 3, is controlled.

The irradiation/non-irradiation changeover instruction supplied from the x-ray irradiation/non-irradiation selecting device 17, drives the switches 29, 34 simultaneously. More specifically, each of the switches 29, 34 is set to the "a" side in the x-ray irradiation state, and to the "b" side in the x-ray non-irradiation state.

An OFF setting circuit 37 is connected to the "b" side of the switch 29. The OFF setting circuit 37 is arranged to supply a signal of a voltage equivalent to the grounding potential. Accordingly, in the x-ray non-irradiation state, a signal of the grounding potential is supplied, instead of the tube voltage target value signal, to the tube voltage deviation amplifier 28. Thus, the tube voltage control feedback loop including the tube voltage deviation amplifier 28 is operated such that the voltage applied to the filament 3 is equal to the grounding potential. This causes the voltage across the filament 3 and the target 2, or the tube voltage, to become 0.

On the other hand, the filament preliminary heating current setting unit 16 is connected to the "b" side of the switch 34. When the switch 34 is set to the "b" side, the tube current trigger circuit 35 is disconnected from the tube current deviation amplifier 33. This causes the tube current control feedback loop to be inoperative. To let flow a current having a predetermined value in the filament 3, the filament preliminary heating current setting unit 16 supplies, to the tube current trigger circuit 35, such a signal as to fix the conduction phase of the thyristor 36 to a predetermined phase. Accordingly, in the x-ray non-irradiation state, a predetermined current for preliminary heating the filament 3 flows therein even though the tube voltage becomes 0 V and the tube current is therefore 0 A.

In the embodiment above-mentioned, in the x-ray non-irradiation state, the tube voltage becomes 0 V, the tube current becomes 0 A and a predetermined current for preliminary heating the filament 3 flows therein to prevent the temperature thereof from being lowered. Accordingly, even though x-ray irradiation/non-irradiation is often repeated, the target 2 is not contaminated and the filament 3 is not thermally stressed. Further, a mechanical x-ray shutter is not required to be disposed at the x-ray window 5 of the tube bulb holder 4 as done in a diffractometer of prior art.

It is a matter of course that each of the switches 29, 34 in the embodiment above-mentioned may be a non-contact relay using a semiconductor or a semiconductor switch, instead of a relay having mechanical contacts.

The embodiment above-mentioned adopts, as the tube-voltage and tube-current control method, a so-called phase control method arranged to control the conduction phases of thyristors. It is a matter of course, however, that the present invention is not limited to the method above-mentioned, but can adopt other known control method such as an inverter method using a high-frequency alternating current.

I claim:

1. In an x-ray diffractometer having an x-ray tube bulb, an x-ray generating power source device for supplying a predetermined tube voltage and a predetermined tube current to the x-ray tube bulb, and x-ray irradiation/non-irradiation selecting means for selecting one of states of irradiation and non-irradiation of x-rays generated from the x-ray tube bulb to a sample, said x-ray diffractometer characterized in that:

said x-ray irradiation/non-irradiation selecting means is arranged to switch states of supply and non-supply of said tube voltage to said x-ray tube bulb; and said x-ray generating power source device comprises filament preliminary heating current supply means for letting flow a constant preset current in the filament of said x-ray tube bulb in said state of non-supply of said tube voltage.

2. An x-ray diffractometer according to claim 1, wherein:

said x-ray generating power source device comprises tube voltage setting means for generating a target value signal of said tube voltage of said x-ray tube bulb, and a tube voltage control feedback loop for comparing said tube voltage target value signal and a moment-by-moment detection signal of said tube voltage of said x-ray tube bulb with each other and for controlling said tube voltage according to a deviation between said target value signal and said detection signal; and said x-ray irradiation/non-irradiation selecting means is arranged such that, instead of said tube voltage target value signal, such a target value signal as to generate a tube voltage on the level of a grounding potential is supplied to said x-ray generating power source device in said x-ray non-irradiation state.

3. An x-ray diffractometer according to claim 1, wherein:

said x-ray generating power source device comprises tube current setting means for generating a target value signal of said tube current of said x-ray tube bulb, and a tube current control feedback loop for comparing said tube current target value signal and a moment-by-moment detection signal of said tube current flowing in said x-ray tube bulb with each other and for controlling, according to a deviation between said target value signal and said detection signal, a current to be supplied to said filament of said x-ray tube bulb; and said filament preliminary heating current supply means is arranged such that, in said x-ray non-irradiation state, a constant preset current flows in said filament without the use of said tube current control feedback loop.

* * * * *